US009003710B2

(12) United States Patent
Kellum, III et al.

(10) Patent No.: US 9,003,710 B2
(45) Date of Patent: Apr. 14, 2015

(54) TILT SASH COUNTERBALANCE SYSTEM INCLUDING CURL SPRING MOUNT STABILIZER

(71) Applicant: Caldwell Manufacturing Company North America, LLC, Rochester, NY (US)

(72) Inventors: Wilbur James Kellum, III, Hilton, NY (US); Jay Sofianek, Webster, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 13/938,632

(22) Filed: Jul. 10, 2013

(65) Prior Publication Data

US 2014/0013669 A1 Jan. 16, 2014

Related U.S. Application Data

(60) Provisional application No. 61/669,922, filed on Jul. 10, 2012.

(51) Int. Cl.
*E05D 13/00* (2006.01)

(52) U.S. Cl.
CPC ..... *E05D 13/1276* (2013.01); *E05Y 2900/148* (2013.01)

(58) Field of Classification Search
USPC ..... 49/445, 181, 176; 16/193
See application file for complete search history.

(56) References Cited

U.S. PATENT DOCUMENTS

| | | | | | |
|---|---|---|---|---|---|
| 3,150,420 | A * | 9/1964 | Brenner | 49/445 |
| 5,353,548 | A * | 10/1994 | Westfall | 49/446 |
| 5,463,793 | A * | 11/1995 | Westfall | 16/197 |
| 7,076,835 | B2 * | 7/2006 | Harold et al. | 16/197 |
| 7,735,191 | B2 * | 6/2010 | Tuller | 16/193 |
| 8,074,402 | B2 * | 12/2011 | Tuller | 49/445 |
| 2004/0206003 | A1 * | 10/2004 | Kunz et al. | 49/181 |
| 2007/0101654 | A1 * | 5/2007 | Robertson | 49/445 |
| 2009/0260295 | A1 * | 10/2009 | Tuller | 49/445 |
| 2011/0239402 | A1 | 10/2011 | Steen et al. | |

OTHER PUBLICATIONS

"Inverted Balance Constant Force" Amesbury [Brochure], Amesbury Window Hardware, Sep. 2010, one page.
"It's a Clean Sweep." Amesbury [Brochure], Amesbury Hardware Products, Date unknown, one page.

* cited by examiner

*Primary Examiner* — Jery Redman
*Assistant Examiner* — Marcus Menezes
(74) *Attorney, Agent, or Firm* — Harness, Dickey & Pierce, P.L.C.

(57) ABSTRACT

A window balance assembly for installation in a window assembly can include a balance portion that is connected to a carrier that may have a first and second side. The balance portion may be arranged to be drawn out of the carrier on the first or second sides of the carrier. The balance portion may be a spring member or element. As the spring element is drawn out of the carrier, contact made between the spring element and the carrier may generate a friction that results in undesired chatter of the spring element and/or audible noise from the carrier. This friction may be reduced by controlling the contact made between the spring element and the carrier. Further, a reduction of friction between the spring element and the carrier may result in a reduction in spring chatter and a reduction in audible noise from the carrier.

12 Claims, 13 Drawing Sheets

TILT SASH COUNTERBALANCE SYSTEM INCLUDING CURL SPRING MOUNT STABILIZER

This application claims the benefit of U.S. Provisional Application No. 61/669,922, filed on Jul. 10, 2012. The entire disclosure of the above application is incorporated herein by reference.

FIELD

The present disclosure relates to window balance assemblies. More particularly, the disclosure pertains to window balance hardware and including balance carriers.

BACKGROUND

Window assemblies in residential, commercial and industrial buildings may include one or more window sashes that are movable vertically within a window jamb. Window sashes that move vertically to open and close often include two or more balance assemblies. The balance assemblies urge the window sash upward (i.e., toward an open position for a lower sash or toward a closed position for an upper sash) to assist a user in moving the window sash and to retain the window sash at a position selected by the user.

Locking mechanisms to lock the carrier (also known as a "shoe") in the jamb channels when the sash of a tilt-sash window assembly is tilted are known in the art. U.S. Pat. No. 5,353,548, entitled "CURL SPRING SHOE BASED WINDOW BALANCE SYSTEM", issued Oct. 11, 1994 to Westfall, discloses a window balance system for a tilt-sash window assembly having a pair of constant force curl springs having curled convolutions carried by sash shoes and free end regions mounted in sash shoe channels above the region of travel of the shoes. The curl tendency of the springs imparts a lift to the curled spring convolutions, and the shoes transmit the lift to the sash. The springs curl into the convolutions as the shoes rise, and the springs uncurl from the shoes into the shoe channels when the shoes move downward. An annular cam on a receiver in the shoe locks the shoe in the shoe channel when the sash is tilted outward. The receiver has an opening which receives a pin or pivot bar connected to the sash such that when the sash is tilted, the receiver rotates with the sash, whereby the cam rotates to separate the two body parts of the shoe body such that they bind against the shoe channel to prevent upward or downward movement of the shoe while the sash is tilted. The disclosure of U.S. Pat. No. 5,353,548 is hereby incorporated herein in its entirety.

SUMMARY

This section provides a general summary of the disclosure, and is not a comprehensive disclosure of its full scope or all of its features.

The present disclosure is directed to a window balance assembly for installation in a window assembly. The balance assembly can include a balance portion that is connected to a carrier that may have a first and second side. The balance portion may be arranged to be drawn out of the carrier on the first or second sides of the carrier. The balance portion may make contact with the inside portion of the carrier as the balance portion is drawn out of the carrier. The balance portion may be a spring member or element.

As the spring element is drawn out of and retracted back into the carrier, contact made between the spring element and the carrier may generate a friction that results in undesired chatter of the spring element and/or audible noise from the carrier. The audible noise can result from the spring element moving within the carrier, in particular slipping or sliding around within the carrier and forcefully contacting the walls of the carrier. Also, audible noise can occur when the spring element extends or bulges out from the sides of the carrier and contacts the jamb channel. For example, when the spring element is "playing-in" (i.e., recurling or retracting), the growth of the coil portion of the spring and movement of the spring may cause at least a portion of the spring to extend from the carrier and contact a wall of the jamb channel. Also, excessive or undesired forces may be formed due to the contact. In addition, greater contact area can lead to greater wear. This friction may be reduced by controlling contact made between the spring element and the carrier. Further, a reduction of friction between the spring element and the carrier may result in a reduction in spring chatter and a reduction in audible noise from the carrier.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
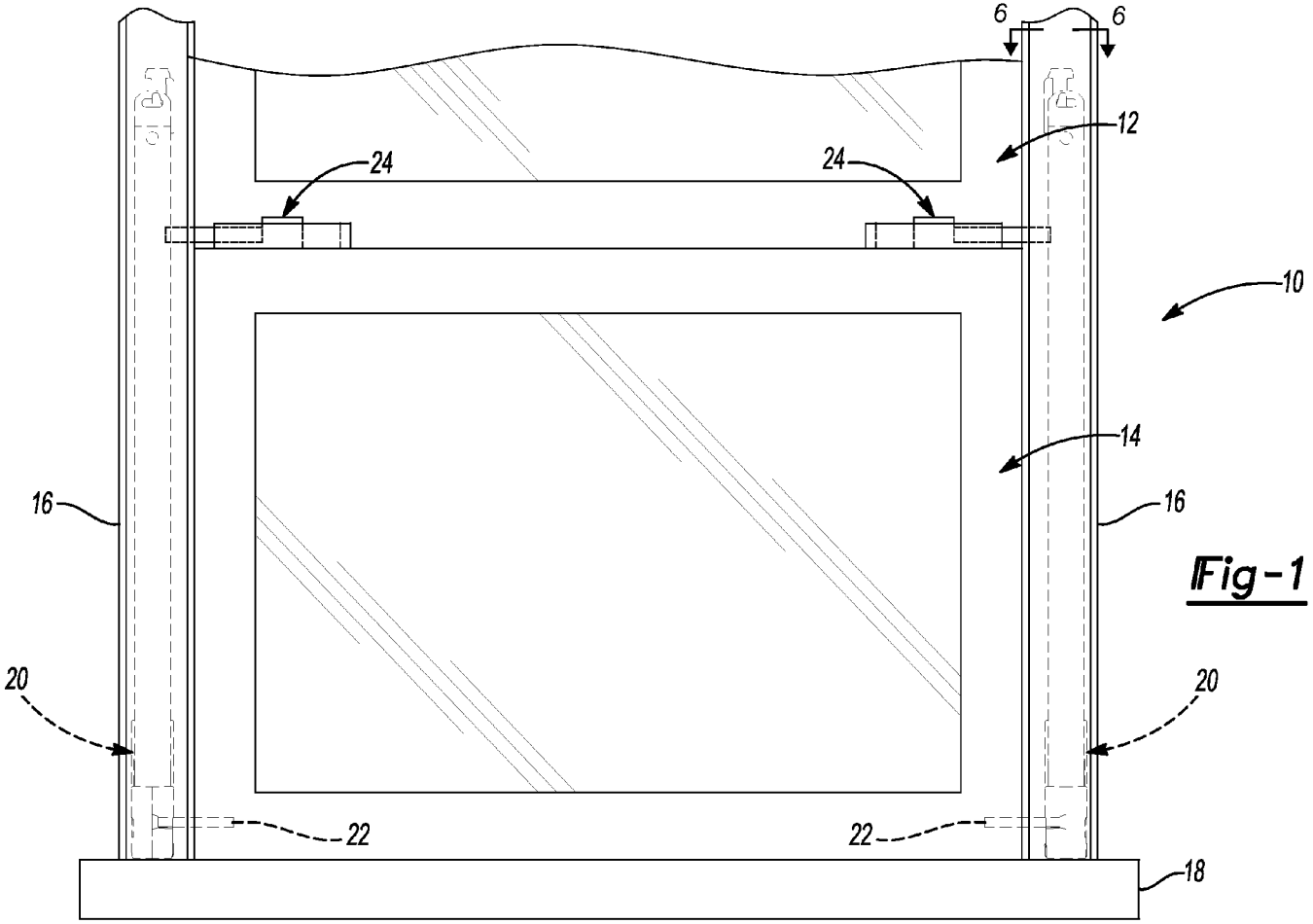
FIG. 1 is a front view of a window assembly including window balance assemblies according to the principles of the present disclosure.

With reference to FIGS. 1-9, a window assembly 10 is provided that may include an upper sash 12, a lower sash 14, a pair of window jambs 16, a window sill 18, and two or more window balance assemblies or cartridges 20. In the particular embodiment illustrated in FIG. 1, the upper sash 12 is fixed relative to the window sill 18 (i.e., in a single hung window assembly). However, in some embodiments, the upper sash 12 may be movable relative to the window sill 18 between a raised or closed position and a lowered or open position (i.e., in a double hung window assembly). The lower sash 14 may be raised and lowered between open and closed positions and may be connected to the window balance assemblies 20. The balance assemblies 20 assist a user in opening the lower sash 14 and maintain the lower sash 14 in a desired position relative to the window sill 18.

The lower sash 14 may include a pair of pivot bars 22 and a pair of tilt latch mechanisms 24. The pivot bars 22 may extend laterally outward in opposing directions from a lower portion of the lower sash 14 and may engage corresponding ones of the window balance assemblies 20. The tilt latch mechanisms 24 may extend laterally outward in opposing directions from an upper portion of the lower sash 14 and may selectively engage corresponding ones of the window jambs 16. The tilt latch mechanisms 24 may be selectively actuated to allow the lower sash 12 to pivot about the pivot bars 22 relative to the window jambs 16 to facilitate cleaning of an exterior side of the window assembly 10, for example.

It will be appreciated that in a double hung window assembly, the upper sash 12 may also be connected to one, two or more of the window balance assemblies 20 to assist a user in opening the upper sash 12 and maintaining the upper sash 12 in a selected position relative to the window sill 18. In such a window assembly, the upper sash 12 may also include tilt latches and pivot bars to allow the upper sash 12 to pivot relative to the window jambs 16 in the manner described above.

Figure 6:
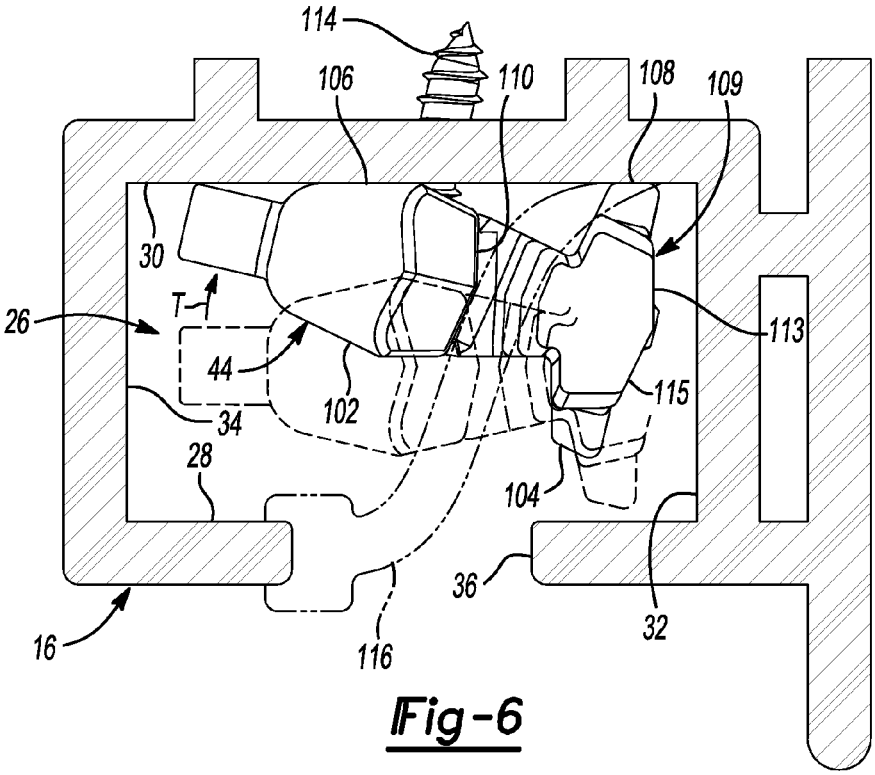
FIG. 6 is a cross-sectional view taken along 6-6 in FIG. 1 of a window jamb and the mounting bracket of the window balance assembly of FIG. 2.
Figure 7:
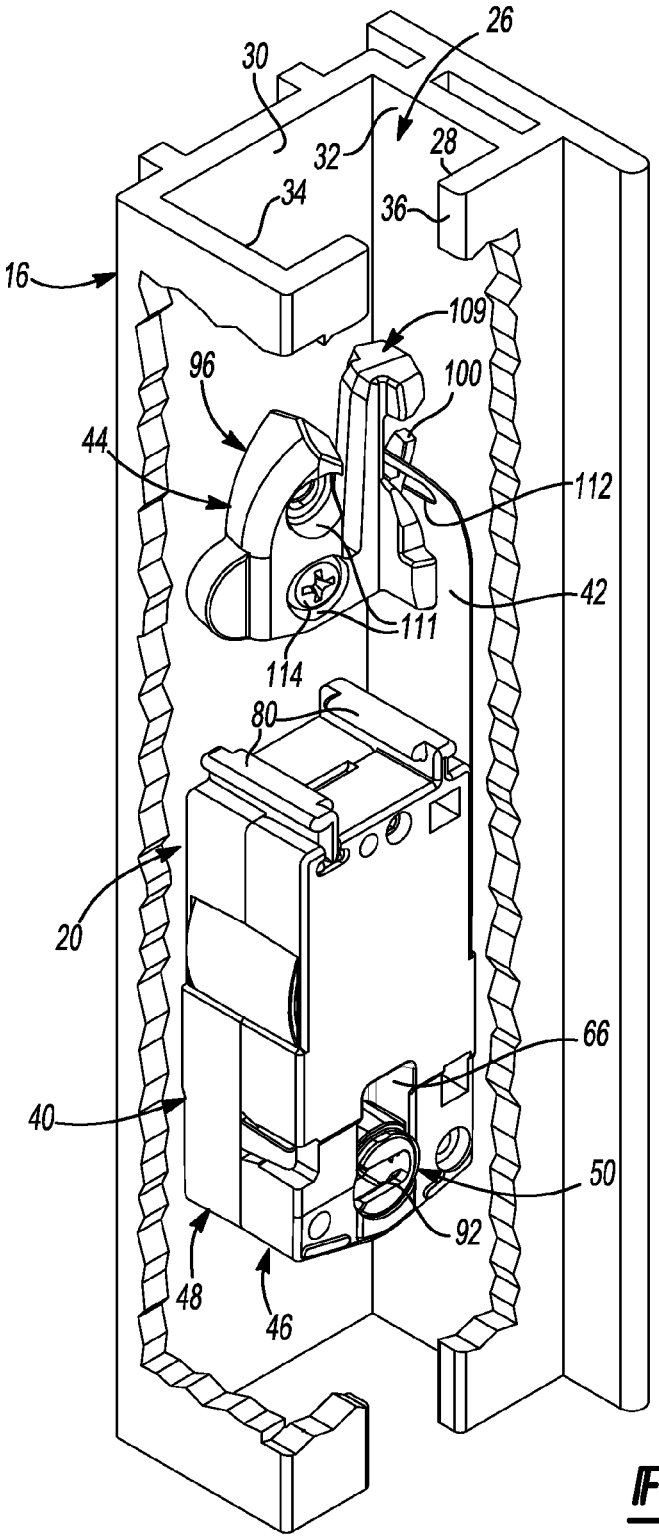
FIG. 7 is a partially cut-away perspective view of the window balance assembly installed in a window jamb according to the principles of the present disclosure.

Each of the window jambs 16 may include a jamb channel 26 defined by a first wall 28, a second wall 30 opposite the first wall 28, and third and fourth walls 32, 34 disposed perpendicular to the first and second walls 28, 30 (FIGS. 6 and 7). The first wall 28 may include a slot 36 that extends vertically and is adjacent the lower sash 14. The window balance assembly 20 may be installed within the jamb channel 26. The pivot bar 22 may extend through the slot 36 and into the jamb channel 26 to engage the window balance assembly 20. The tilt latch mechanism 24 may also selectively engage the slot 36 to lock the lower sash 14 in an upright position (FIG. 1).

Each of the window balance assemblies 20 may include a carrier 40, a curl spring 42, and a mounting bracket 44. The window balance assemblies 20 may be initially assembled and shipped in an uninstalled or shipping configuration (shown in FIGS. 2 and 4) and may be subsequently installed onto the window assembly 10 and placed in an installed configuration (shown in FIGS. 7-9) by a window manufacturer, a construction or renovation contractor, or a homeowner, for example.

The carrier 40 (also referred to as a shoe) may engage the lower sash 14 and house a curled portion 45 of the curl spring 42. The mounting bracket 44 may engage an uncurled end portion 47 of the curl spring 42 and may be fixed relative to the window jamb 16, as shown in FIG. 7. The curl spring 42 may resist being uncurled such that the curl spring 42 exerts an upward force on the carrier 40, thereby biasing the lower sash 14 toward the open position.

The carrier 40 may include a first housing portion 46, a second housing portion 48, and a receiver 50. The first and second housing portions 46, 48 may be identical components that fit together to form a housing for the curl spring 42 and the receiver 50. Forming the first and second housing portions 46, 48 as identical components can reduce the total number of different individual components that must be manufactured and facilitate "poka-yoke" assembly of the carrier 40. That is, assembly of the carrier 40 is simplified, proper assembly does not require selecting the correct one of each of a pair of different mating components to assemble together.

Each of the first and second housing portions 46, 48 may include an exterior face 52, an interior face 54, a top end 56, a bottom end 58, a first side 60, and a second side 62. An aperture 64 disposed proximate the bottom end 58 may extend through the exterior and interior faces 52, 54 and may rotatably engage the receiver 50. An arcuate recess 65 formed in the interior face 54 may be concentric with the aperture 64 and may partially surround the aperture 64. A first slot 66 in communication with the aperture 64 may be formed in the exterior face 52 and may extend vertically upward (relative to the view shown in FIG. 4) and or away from the aperture 64.

A barbed protuberance 68 may be disposed at or proximate to the first side 60 and may extend outward from the interior face 54. A second slot 70 may be formed in the second side 62 generally opposite the barbed protuberance 68 such that when the first and second housing portions 46, 48 are assembled together, the barbed protuberances 68 may engage the respective second slot 70 of the opposed first and second housing portion 46, 48 (shown best in FIG. 2). The length of the barbed protuberance 68 may be sufficient to allow the first and second housing portions 46, 48 to move relative to each other between a first position (FIG. 8) and a second position (FIG. 9) without disengaging each other.

The interior face 54 of the housing portions 46, 48 may include generally cylindrical recesses 72 that can enclose the curl spring 42 when assembled. The cylindrical recesses 72 can define an arcuate housing region 130. Openings 76 in communication with the recess 72 may be formed in the first and second ends 60, 62 through which the uncurled end portion 47 of the curl spring 42 may extend toward the mounting bracket 44.

The arcuate housing region 130 can contact and guide the curl spring 42 when the curl spring 42 is curled or uncurled, whether the housing member is fixed or moveable relative to the window jamb. When the curl spring 42 is curled or uncurled, the curl spring 42 makes contact and bear on at least a portion of a surface of the arcuate housing region 130. The arcuate housing region 130 guides the curl spring 42 to ensure a controlled curl or uncurl of the curl spring 42 as the curl spring 42 is drawn out of the cylindrical recesses 72. As is understood, and illustrated, the arcuate housing region 130 according to various embodiments, can include a thickness or depth within the housing such that the cylindrical recesses 72 defines a volume alone and together when the first and second housing portions 46, 48 are assembled. As will be described later, the contact made between the curl spring 42 and the arcuate housing region 130 may generally be understood to be along a line (e.g. such as defined by an edge) that is defined by the depth of the arcuate housing region 130. The contact of the curl spring 42 and the arcuate housing region 130 may generate a friction that can result in an audible noise and a degraded performance (e.g. increased forces or wear) of the curl spring 42, especially if the contact is greater than a selected amount.

The first and second housing portions 46, 48 may also each include a projection 80 and a third slot 82 disposed at the top end 56. The projection 80 may extend from the exterior face 52 beyond the interior face 54 and may include a generally I-shaped cross-section having upper and lower flanges 84, 86. The third slots 82 may be sized and shaped to enable the third slots 82 of the first housing portion 46 and the second housing portion 48 to slidably engage the lower flanges 86 of the second housing portion 48 and the first housing portion 46, respectively. In a similar manner, pegs 88 and apertures 90 formed in the interior face 54 of the first and second housing portions 46, 48 may be sized and positioned to slidably engage each other when the first and second housing portions 46, 48 are assembled together.

The receiver 50 may be a generally cylindrical member including slotted recesses 92 formed in each end thereof and an annular cam 94 extending around a portion of the perimeter of the receiver 50. One of the recesses 92 of each of the window balance assemblies 20 may receive a corresponding one of the pivot bars 22 extending from the lower sash 14. As described above, the receiver 50 may be rotatable within the aperture 64 to allow the lower sash 14 to pivot about the pivot bar 22 between an upright position and a tilted position. The angular span of the cam 94 may correspond to the angular span of the arcuate recess 65 that partially surrounds the aperture 64 in the first and second housing portions 46, 48 such that when the lower sash 14 is in the upright position, the cam 94 fits within the arcuate recess 65.

Figure 2:
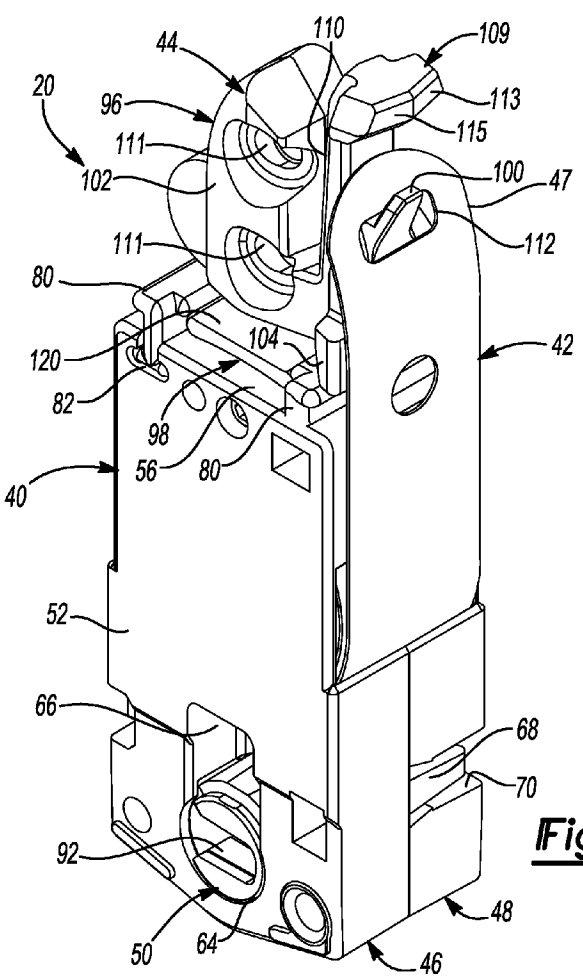
FIG. 2 is a perspective view of a window balance assembly in an uninstalled configuration according to the principles of the present disclosure.
Figure 8:
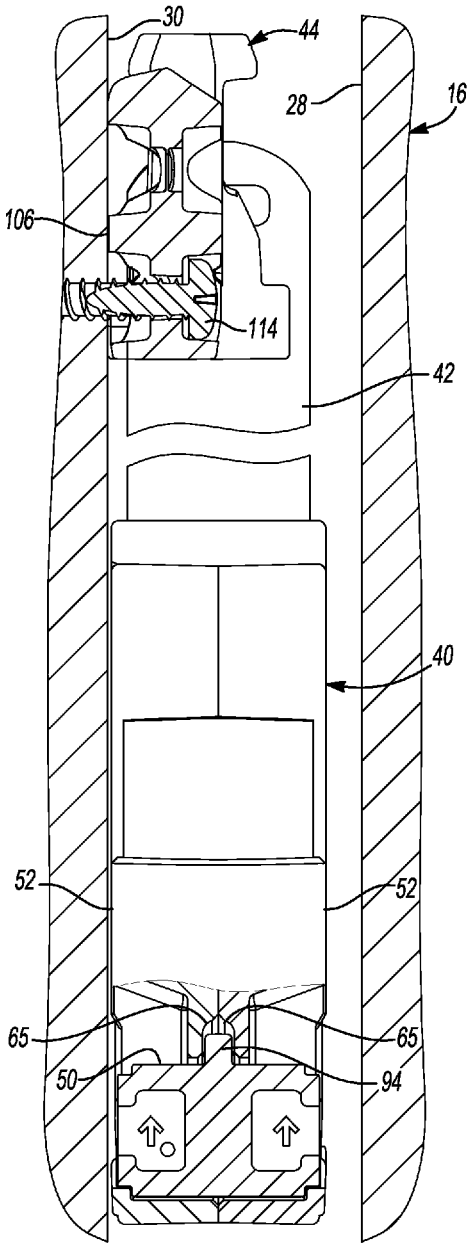
FIG. 8 is a side view of the window balance assembly in a first position according to the principles of the present disclosure.

When the receiver 50 is oriented such that the slotted recess 92 is oriented horizontally relative to the carrier 40, the cam 94 may be fully received within the arcuate recess 65 (see FIGS. 2 and 8). When the cam 94 is received in the arcuate recess 65, the first and second housing portions 46, 48 are allowed to fully close together, as shown in FIG. 8. In the configuration of FIG. 8, the carrier 40 is in an unlocked or unrestricted position, such that the carrier 40 may be generally unrestricted from moving upward and downward in the window jamb 16 as the lower sash 14 moves between the open and closed positions.

Figure 4:
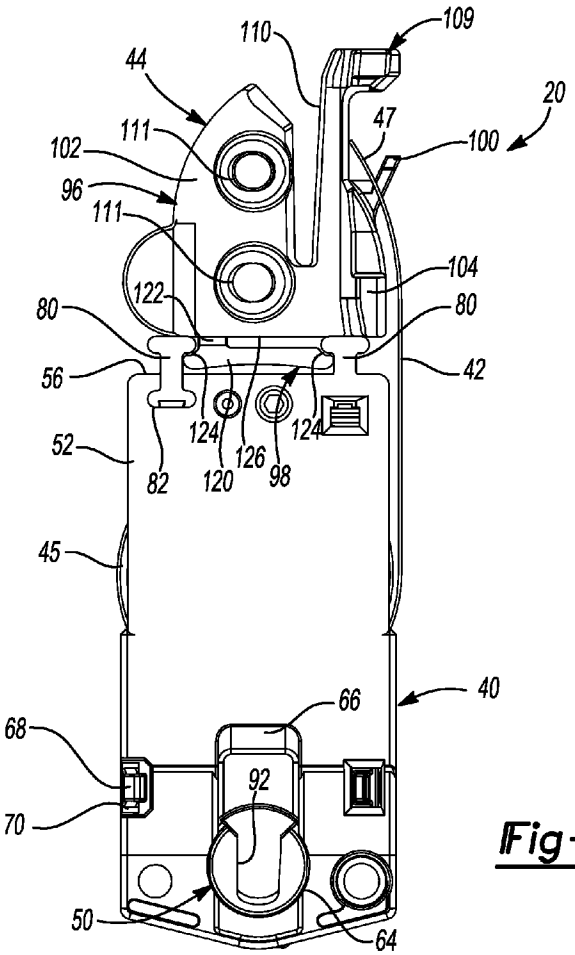
FIG. 4 is a side view of the window balance assembly of FIG. 2.
Figure 9:
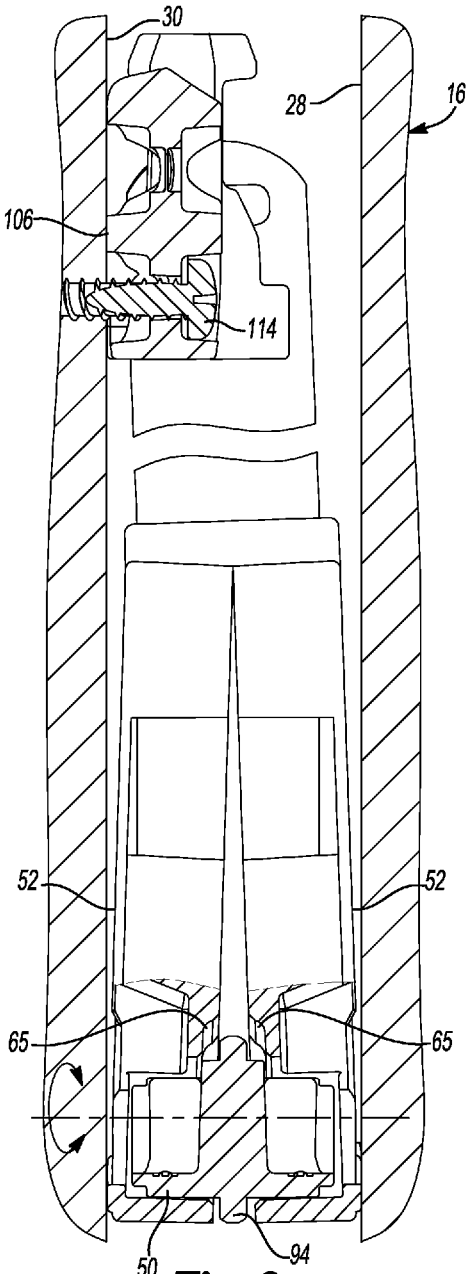
FIG. 9 is a side view of the window balance assembly in a second position according to the principles of the present disclosure.

When the lower sash 14 is tilted relative to the window jamb 16, the pivot bar 22 rotates the receiver 50 toward the orientation shown in FIGS. 4 and 9, in which the slotted recess 92 is oriented vertically and is generally aligned with the first slot 66 in the carrier 40. Rotating the receiver 50 in this manner moves the cam 94 out of the arcuate recess 65 and causes the cam 94 to force the interior faces 54 of the first and second housing portions 46, 48 away from each other. In this manner, the exterior faces 52 of the first and second housing portions 46, 48 are forced against the first and second walls 28, 30 of the jamb channel 26, as shown in FIG. 9. Forcing the exterior faces 52 outward against the first and second walls 28, 30 creates friction that may, and in some embodiments will, be sufficient to lock the carrier 40 in place relative to the jamb channel 26. Accordingly, when the lower sash 14 is in a tilted position, the window balance assembly 20 may be prevented from exerting a net upward force on the lower sash 14.

When the carrier 40 is locked in place within the jamb channel 26, the lower sash 14 can be removed from the window assembly 10 various purposes, such as maintenance or replacement. To remove the lower sash 14, the pivot bars 22 can be removed from the receivers 50 by moving the pivot bars 22 upward out of the slotted recesses 92 and into the first slot 66 in the carriers 40. Thereafter, the pivot bars 22 can be removed from the window balance assemblies 20 so that the lower sash 14 can be removed from the window assembly 10.

The opposite procedure may be employed to install the lower sash 14 into the window assembly 10. That is, with the lower sash 14 tilted relative to the upper sash 12 and/or jamb channel, the pivot bars 22 may be inserted into the first slots 66 in the carrier 40 and lowered into engagement with the slotted recesses 92 in the receivers 50. The lower sash 14 may then be pivoted to the upright position relative to the upper sash 12, which includes rotating the receiver 50 to the position shown in FIGS. 2 and 8. As described above, rotating the receiver 50 to the position shown in FIGS. 2 and 8 allows the first and second housing portions 46, 48 to fully close together, thereby reducing or eliminating friction between the carrier 40 and the jamb channel 26 to allow unrestricted movement of the carrier 40 therein.

The mounting bracket 44 may be formed from a polymeric material, for example, and may include a body portion 96 and an attachment portion 98. The body portion 96 may include a hook or latch 100, first, second, third and fourth mounting surfaces 102, 104, 106, 108 (FIG. 6), a slot 110, and one or more counterbored or countersunk mounting apertures 111. The latch 100 may extend generally upward and outward (relative to the view shown in FIG. 4) from the body portion 96 and may engage an aperture 112 in the uncurled end portion 47 of the curl spring 42.

The first and second mounting surfaces 102, 104 may be substantially coplanar with each other and disposed at a non-perpendicular angle relative to the exterior face 52 of the first housing portion 46 when the window balance assembly 20 is in the uninstalled or shipping configuration (FIGS. 2 and 4). The third and fourth mounting surfaces 106, 108 may be substantially coplanar with each other and disposed at a non-perpendicular angle relative to the first and second mounting surfaces 102, 104 and relative to the exterior face 52 of the second housing portion 48 when the window balance assembly 20 is in the shipping configuration.

As shown in FIG. 6, when the window balance assembly 20 is in the installed configuration, the third and fourth mounting surfaces 106, 108 may abut the second wall 30 of the jamb channel 26 such that the third and fourth mounting surfaces 106, 108 may be substantially parallel with the exterior faces 52 of the first and second housing portions 46, 48 (FIGS. 6 and 8). One or more fasteners 114 may extend through the one or more mounting apertures 111 and engage the second wall 30 of the jamb channel 26 to secure the mounting bracket 44 to the window jamb 16. While not specifically shown in the Figures, it will be appreciated that the window balance assembly 20 could be mounted within one of the window jambs 16 such that the second wall 30 abuts the first and second mounting surfaces 102, 104 rather than the third and fourth mounting surfaces 106, 108, as described above. Therefore, it is understood that the carrier 40 and mounting bracket 44 may be symmetrical in that any one window balance assembly 20 can be mounted on either left or right sides of the lower sash 14.

In some embodiments, the mounting bracket 44 may include a head portion 109 including a fifth mounting surface 113 or a sixth mounting surface 115 that may abut the third wall 32 of the jamb channel 26 when the window balance assembly 20 is in the installed configuration. The fifth mounting surface 113 may be substantially perpendicular to the third and fourth mounting surfaces 106, 108, and the sixth mounting surface 115 may be substantially perpendicular to the first and second mounting surfaces 102, 104. The head portion 109 may also contact the second wall 32 of the jamb channel 26 to keep the mounting bracket 44 generally upright as the fastener 114 is driven into the second wall 32 to secure the mounting bracket 44 thereto.

In some embodiments, a jamb cover 116 may engage the window jamb 16 and extend through the slot 110 in the mounting bracket 44, as shown in FIG. 6. The jamb cover 116 may engage the first wall 28 of the jamb channel 26 at or proximate the slot 36 via a snap fit, for example. The jamb cover 116 may extend vertically upward from the slot 110 toward an upper portion of the window jamb 16.

The attachment portion 98 of the mounting bracket 44 may include a platform 120 and an integrally formed breakaway tab 122. The platform 120 may include tapered or curved ends 124 that cooperate with a lower surface 126 of the body portion 96 to slidably engage the projections 80 of the carrier 40. When the window balance assembly 20 is in the shipping configuration (FIGS. 2 and 4), the breakaway tab 122 may be integrally formed with the body portion 96 and may interconnect the platform 120 with the body portion 96. The relatively small cross section of the breakaway tab 122 may be a stress riser in the mounting bracket 44 such that when a sufficiently large force is applied to the body portion 96 by the fastener 114 during installation of the mounting bracket 44 into the window jamb 16, the breakaway tab 122 may fail or break to disengage the attachment portion 98 from the body portion 96. In some embodiments, failure of the breakaway tab 122 could include a fracture such that body portion 96 may be permanently removed from the attachment portion 98.

Figure 3:
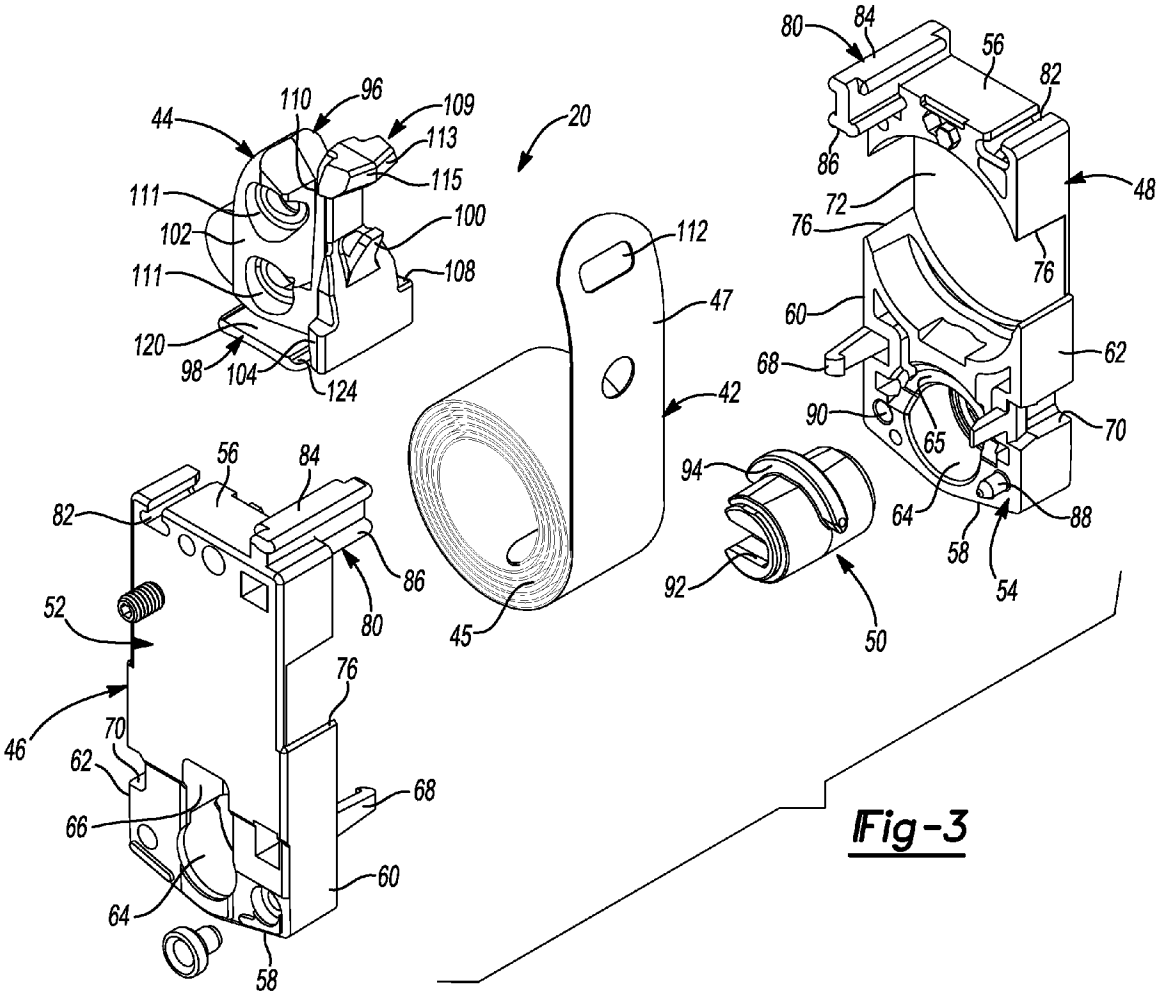
FIG. 3 is an exploded perspective view of the window balance assembly of FIG. 2.
Figure 5:
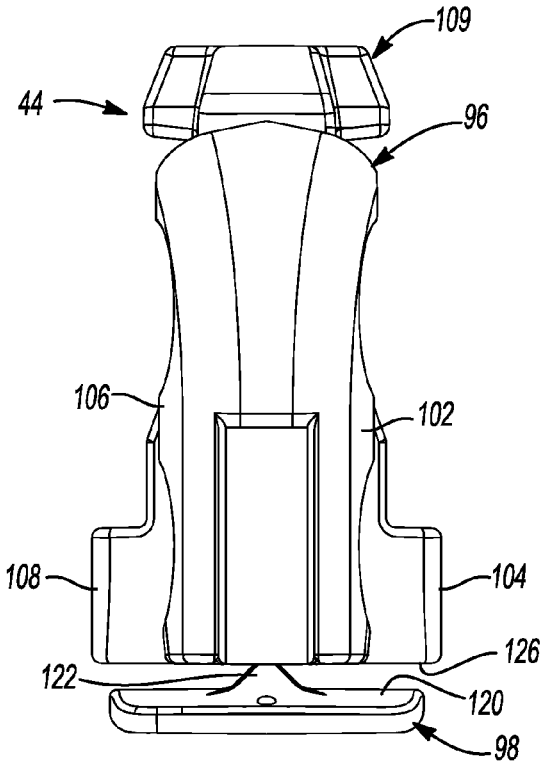
FIG. 5 is a side view of a mounting bracket of the window balance assembly of FIG. 2.

The carrier housing may be formed in various configurations including varying features therein. For example, and with reference to FIGS. 10A and 10B, a carrier housing portion 200 is shown. The carrier housing portion 200 can include the cylindrical recess 72 that may include an arcuate housing region or portion 202 that is similar to the arcuate housing portion 130 discussed above in relation to the first and second housing portions 46, 48. The arcuate housing region 202 can include a complete surface that extends between the two sides 60, 62 which defines a complete or total surface area. In some embodiments, the arcuate housing region 202 may be arranged or formed to control the contact made between the curl spring 42 (as shown in FIG. 3) and the arcuate housing region 202. Controlling the contact can include limiting contact area, as discussed herein, with the total surface area of the complete surface of the arcuate housing region 202. Controlling the contact between the curl spring 42 and the arcuate housing region 202 may result in a reduced friction between the curl spring 42 and the arcuate housing region 202. Further, reducing the friction between the curl spring 42 and the arcuate housing region 202 may allow the curl spring 42 to curl or uncurl in a relatively uniform manner, reducing undesired curl spring chatter or audible noise. The arcuate housing region may be used with an appropriate housing, to control contact with the curl spring, whether the housing is fixable to the jamb 16 or moveable relative to the jamb 16.

For example, the arcuate housing region 202 may be defined by overlapping or intersecting arcuate or cylindrical surfaces of different or same radii. The arcuate housing region 202 may include a first end edge 204 of a first wall 205 defined at least in part by a first center point 208 and a first radius 209 extending therebetween. The arcuate housing region 202 may also include a second end edge 212 and second wall 213 defined at least in part by a second center 214 and a second radius extending 216 therebetween.

The radii 209, 216 originating, respectively, at the two center points 208, 214, can intersect in the arcuate housing region 202 to define a peak or arcuate region center 218. The first and second ends 204, 212 and the center 218 of the arcuate housing region 201 can define contact regions. The contact regions are defined as lines or edges with which the curl spring 42 can come into contact during movement of the curl spring 42 within the cylindrical recess 72 defined by the housing 200 when in an assembled manner. The contact lines are formed by the depth of the arcuate housing region 202 of the cylindrical recess 72 in the housing 200. The first and second ends 204, 212 and the center 218 allow the curl spring 42 to contact less than all of the arcuate housing region 202 during movement of the curl spring 42.

Figure 10A:
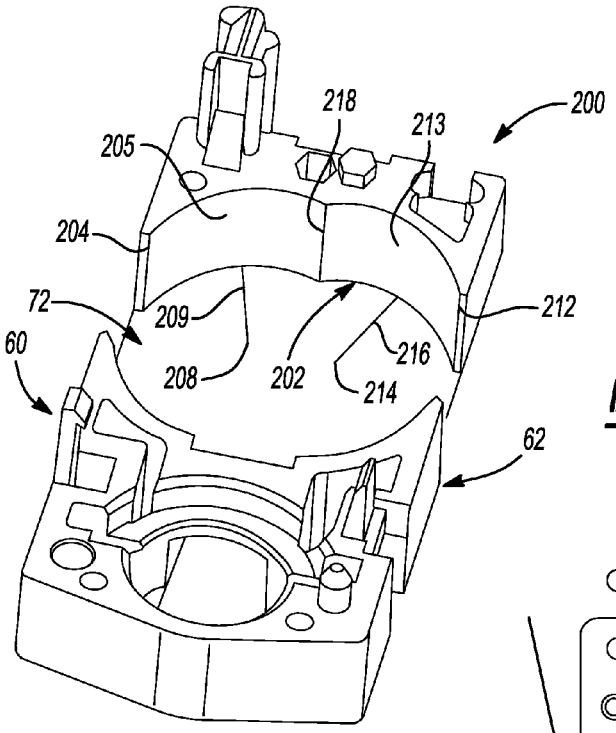
FIG. 10A is a perspective view of a carrier housing for use with a window balance assembly according to the principles of the present disclosure.
Figure 10B:
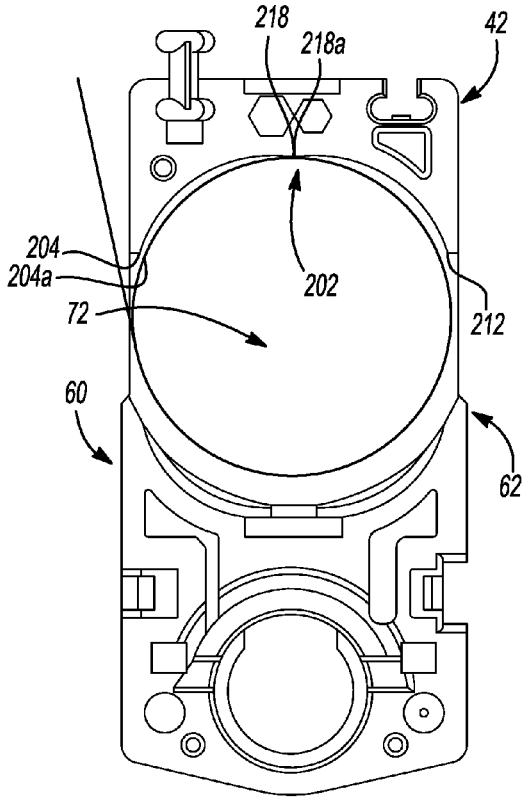
FIG. 10B is a plan view of the carrier housing of FIG. 10A including a curl spring therein.

With particular reference to FIG. 10B, the curl spring 42 can be positioned within the housing 200, in an assembled manner, to contact, for example, locations along lines and/or edges of the arcuate housing region 202. For example, the curl spring 42 may make contact with the at a first contact location 204*a* at the first end 204 and at a second contact location 218 at the center 218 when the curl spring 42 is drawn out and uncurled on the first side 60 of the carrier housing portion 200. It is understood, however, that the curl spring 42 may also contact only the center peak 218 or ride essentially at the peak 218 and/or move along the first arcuate wall 205. Similarly, the curl spring 42 may make contact with one or more contact locations, such as at a third contact location 212*a* at the second end 212 and at the second contact location 218*a* at the center peak 218 when the curl spring 42 is drawn out and uncurled on the second side 62. Further, it is understood, that the curl spring 42 may contact the same portions during recurling to assist in maintaining a location of the curl spring 42 within the housing 200. Maintaining the curl spring 42 within the housing 200 can assist in reducing its movement and therefore audible noise generation within the housing 200. Also, it resists or tends to prevent the curl spring 42 from at least partially extending or exiting from the housing 200 and, thereby, eliminating or reducing contact of the curl spring 42 with a wall of the jamb channel and reducing or eliminating audible noise caused by this contact.

Figure 11A:
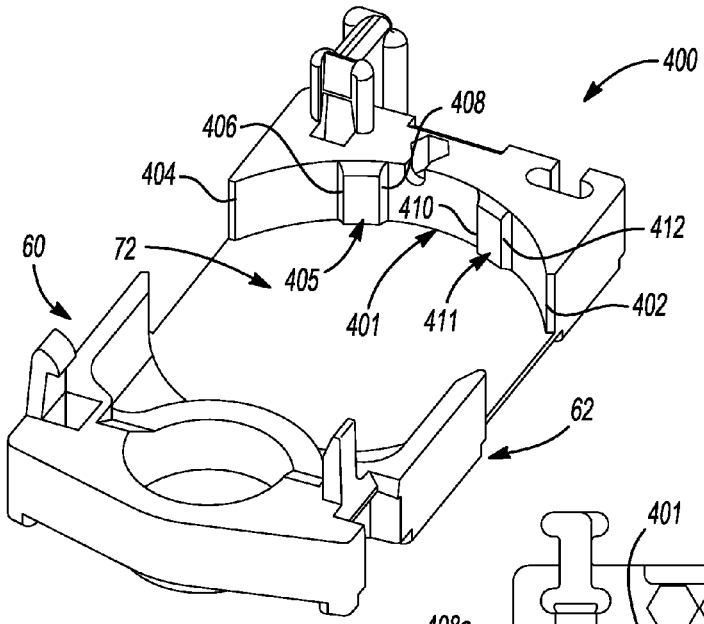
FIG. 11A is a perspective view of another carrier housing for use with a window balance assembly according to the principles of the present disclosure.
Figure 11B:
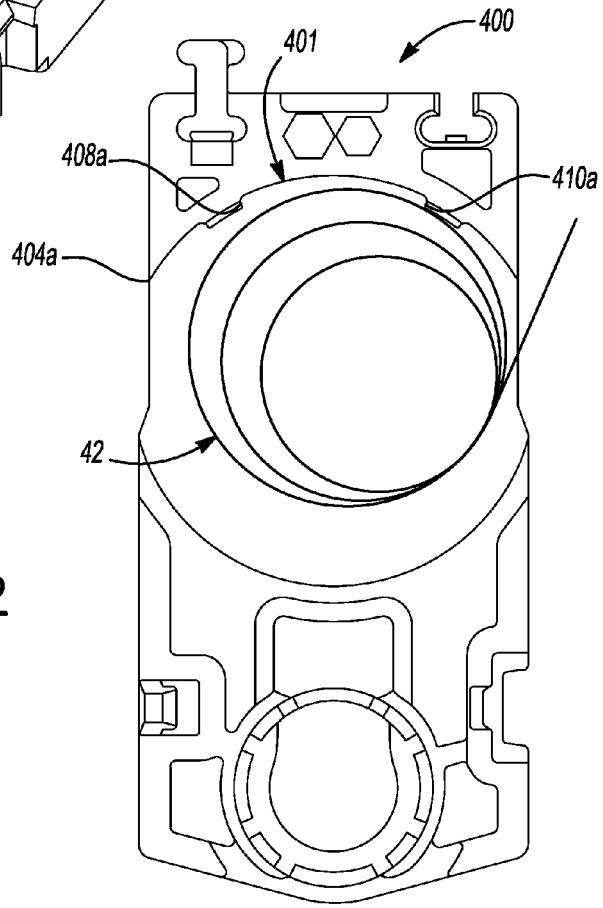
FIG. 11B is a plan view of the carrier housing of FIG. 11A including a curl spring therein
Figure 12:
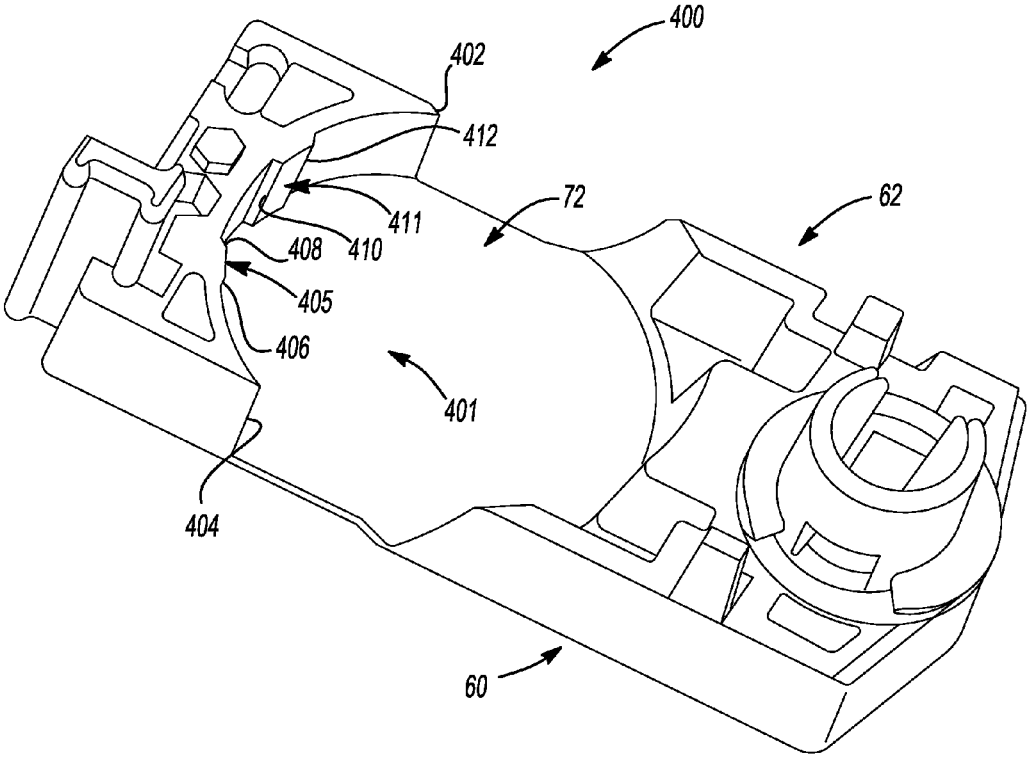
FIG. 12 is a second perspective view of the carrier housing of FIG. 11.

In another embodiment, a carrier housing portion 400 as shown in FIGS. 11A, 11B, and 12 may include a cylindrical recess 72 that includes an arcuate housing region 401. A cam is illustrated in FIG. 12 which may not be identical to the cam 50 illustrated in FIG. 3, but may operate in a similar manner to separate two of the housing portions 400 when a window sash is engaged therein and tilted. The arcuate housing region 401 may be arranged to include at least one flat or arcuate faced protuberances, discussed herein. The arcuate housing region 401 may include end edges 404 and 402, a first faced protuberance 405 and a second faced protuberance 411. The first faced protuberance 405 may include a first edge 406 and a second edge 408. The second faced protuberance 411 may include a third edge 410 and a fourth edge 412. The curl spring 42 can be positioned within assembled housing, including two mating parts of the housing part 400, as discussed above. The curl spring 42 can be retained within the cylindrical recess 72 to contact at least portions of the arcuate housing region 401, as discussed further herein. Nevertheless, the arcuate housing region 401 can again include a complete surface that defines a total surface area that extends between the two sides 60, 62 of the housing 400.

As illustrated particularly in FIG. 11B, the first and second ends 402, 404 and the various edges of the protuberances 405, 411 can limit or control contact of the curl spring 42 with the arcuate housing region 401. The curl spring 42 may make contact at a first contact location 404*a* with the first end edge 404 and selected portions of the first faced protuberance 405, such as a second contact location 408*a* of the second edge 408 when the curl spring 42 is drawn out and uncurled on the first side 60. Similarly, the curl spring 42 may make contact with end edge 402 and selected portions of the second faced protuberance 411, including a contact location 410*a* of the third edge 410, when the curl spring 42 is drawn out and uncurled on the second side 62.

In particular, as the curl spring 42 is drawn out and uncurled on the first side 60, the curl spring 42 can make the first contact location 404*a* at the first edge 404 and the second contact location 408*a* at least at one of the edges 406 or 408 of the first protuberance 405. It will be understood, in various configurations that the curl spring 42 can also contact both of the sides or edges 406 and 408 of the first protuberance 405 along with the first edge 404. Accordingly, it is understood that the curl spring 42 can also make two or more, such as three, contact locations at various edges as the curl spring 42 is drawn out of the first side 60.

With continuing reference to FIG. 11B, as the curl spring 42 is drawn out of the second side 62, the curl spring 42 can make points of contact at the first end edge 402 and one or both of the edges 410 and 412 of the second protuberance 411. According to various embodiments, however, the curl spring may make a point of contact 410*a* at only the edge 410 of the second protuberance 411. Again, it is understood by one skilled in the art, and as illustrated above, that the curl spring 42 can be positioned within the cylindrical recess 72 of the housing 400 in an assembled manner and can be drawn out of at least one of the sides 60, 62 of the housing 400. The curl spring 42, therefore, can move within the housing 400 while it is being drawn out and to make the points of contact at the various edges thus forming lines of contact with the arcuate housing region 401. Further, it is understood, that the curl spring 42 may contact the same portions during recurling to assist in maintaining a location of the curl spring 42 within the housing 400. Maintaining the curl spring 42 within the housing 400 can assist in reducing its movement and therefore audible noise generation within the housing 400. Also, it resists or tends to prevent the curl spring 42 from at least partially extending or exiting from the housing 400 and, thereby, eliminating or reducing contact of the curl spring 42 with a wall of the jamb channel and reducing or eliminating audible noise caused by this contact.

Figure 13A:
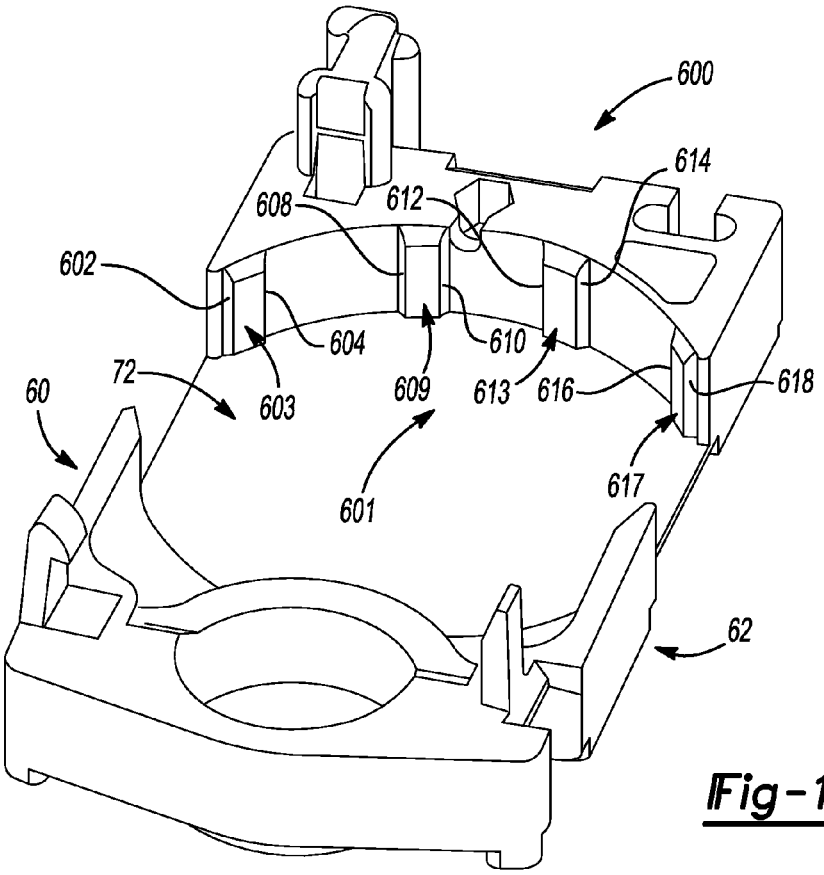
FIG. 13A is a perspective view of another carrier housing for use with a window balance assembly according to the principles of the present disclosure.
Figure 13B:
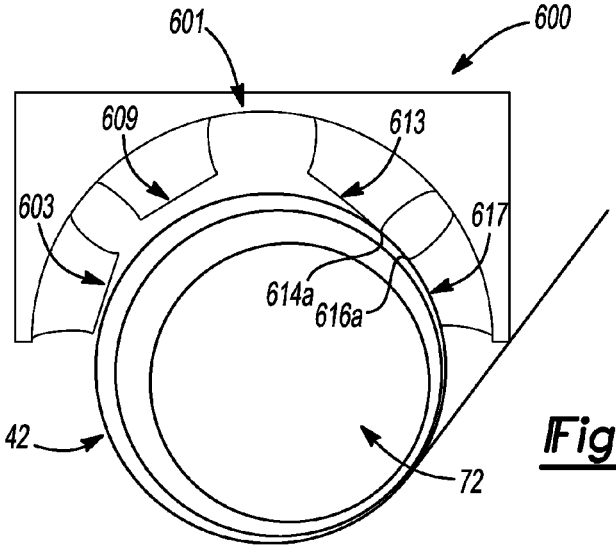
FIG. 13B is a plan view of the carrier housing of FIG. 13A including a curl spring therein

Referring now to FIGS. 13A and 13B, a housing assembly 600 can include the cylindrical recess 72 that defines an arcuate housing region 601. The arcuate housing region 601 may include a first flat or curve faced protuberance 603, a second flat or curve faced protuberance 609, a third flat or curve faced protuberance 613, and a fourth flat or curve faced protuberance 617. The first faced protuberance 603 may be arranged to include a first edge 602 and a second edge 604. The second faced protuberance 609 may be arranged to include a third edge 608 and a fourth edge 610. The third faced protuberance 613 may be arranged to include a fifth edge 612 and a sixth edge 614. The fourth faced protuberance 617 may be arranged to include a seventh edge 616 and an eight edge 618.

The curl spring 42 can be positioned within the housing 600 in the cylindrical recess 72, as discussed above. The curl spring 42 can be drawn out of either the first or second sides 60, 62 of the assembled housing 600. Accordingly, as the curl spring 42 is drawn out and uncurled from the housing 600, it can contact various portions of the arcuate housing region 600. For example, each of the protuberances 603, 609, 613, and 617 can define regions or contact locations for the curl spring 42 as it is drawn out from the different sides 60, 62. As an example, the curl spring 42 can contact the seventh and eighth edges of the fourth protuberance 617 as the curl spring 42 is drawn out of the second side 62. The curl spring 42 may also make additional contact with at least one of the fifth and sixth edges 612, 614 of the third protuberance 613. In one embodiment, as illustrated in FIG. 13B, the curl spring 42 may have a first contact location 614*a* with the sixth edge 614 of the third protuberance 613 and a second contact location 616*a* with the seventh edge 616 of the fourth protuberance 614 as the curl spring 42 is drawn out of the second side 62.

According to various other embodiments, as the curl spring is drawn out of the first side 60, the curl spring 42 may contact both of the first and second edges 602 and 604 of the first protuberance 603. Alternatively, or in addition thereto, the curl spring 42 may contact one or both of the third or fourth edges 608, 610 of the second protuberance 609. In a further alternative, the curl spring 42 may contact the first edge 602 of the first protuberance 603 and the third edge 608 of the second protuberance 609 as the curl spring 42 is drawn out of the first side 60. Accordingly, the curl spring can contact one, two, three or a selected number of the edges of the protuberances as it is drawn out of the respective side 60, 62 of the housing 400. Regardless of the contact number of contact locations and the specific edges contacted, the contact of the curl spring 42 with the arcuate retaining surface 601, which extends between the two sides 60, 62 of the housing 600, can be less than contact with the complete surface that defines a total surface area or majority thereof of the arcuate housing region 601. Further, it is understood, that the curl spring 42 may contact the same portions during recurling to assist in maintaining a location of the curl spring 42 within the housing 600. Maintaining the curl spring 42 within the housing 600 can assist in reducing its movement and therefore audible noise generation within the housing 600. Also, it resists or tends to prevent the curl spring 42 from at least partially extending or exiting from the housing 600 and, thereby, eliminating or reducing contact of the curl spring 42 with a wall of the jamb channel and reducing or eliminating audible noise caused by this contact.

Figure 14A:
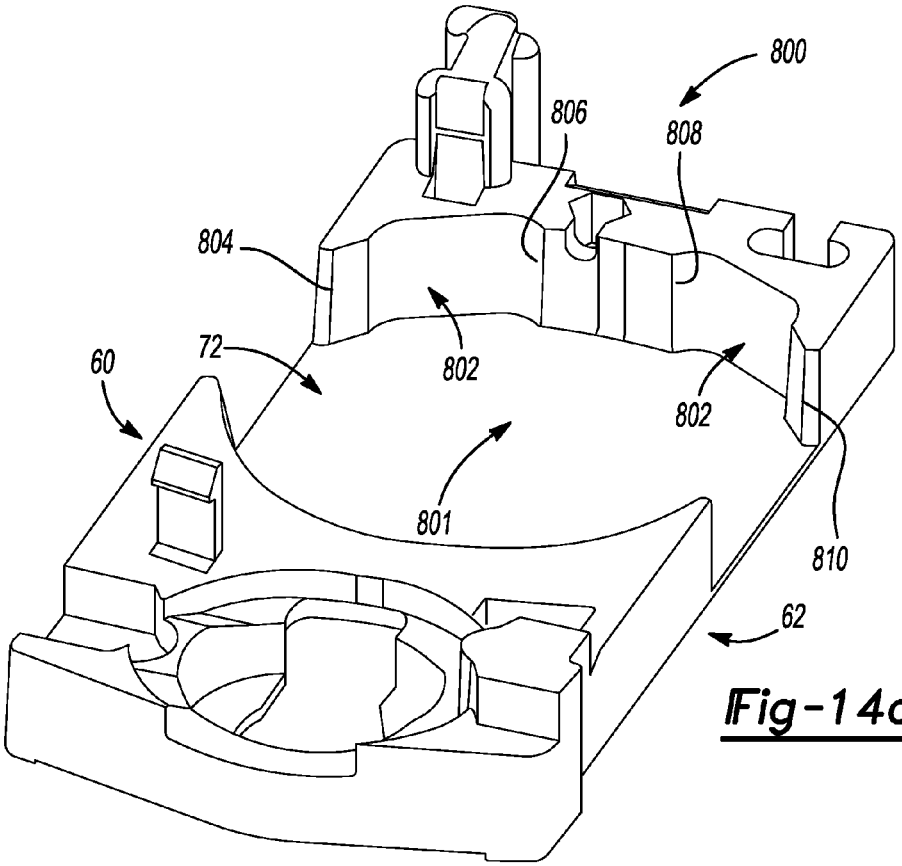
FIG. 14A is a perspective view of another carrier housing for use with a window balance assembly according to the principles of the present disclosure.
Figure 14B:
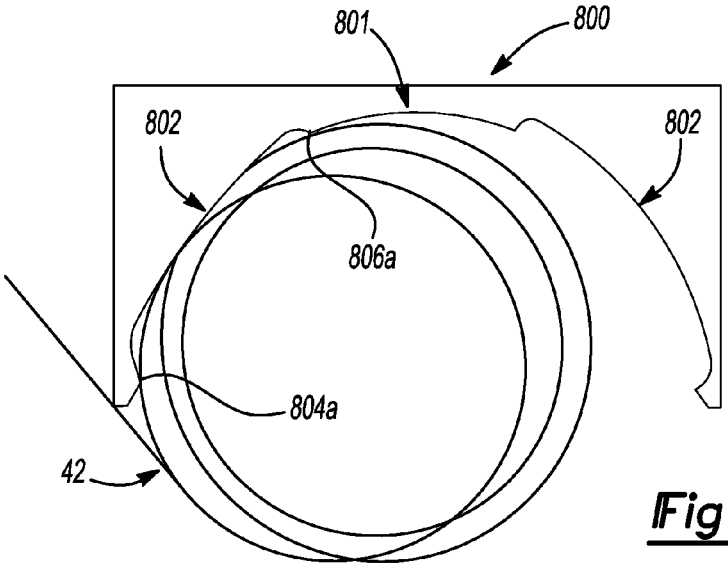
FIG. 14B is a plan view of the carrier housing of FIG. 14A including a curl spring therein

In another embodiment, a carrier housing portion 800 as shown in FIGS. 14A and 14B, may include the cylindrical recess 72 that defines an arcuate housing region 801. The arcuate housing region 801 may include at least one recessed portion 802, or any selected number of recessed portions, including two recessed portions 802 as illustrated in FIG. 14A. The two recessed portions 802, can define various edges including a first edge 804, a second edge 806, a third edge 808, and a fourth edge 810. The edges 804-810 defined by the arcuate housing region 801 and the respective recesses 802 can define contact edges for the curl spring 42 when positioned within a housing 800. Again, the arcuate housing region 801 can extend between the two sides 60 and 62 of the housing 800. The edges 804-810 can reduce or minimize contact of the curl spring 42 to at least less than the entire surface area of the arcuate housing region 801.

Accordingly, for example, as the curl spring 42 is drawn out and uncurled through the first side 60, the curl spring 42 can have a first contact location 804*a* at the first edge 804 and a second contact location 806*a* at the second edge 806. It will be understood, however, according to various configurations that the curl spring 42 may contact only the first edge 804 while being drawn out and uncurling from the housing 800. Similarly, the curl spring 42 can contact the fourth edge 810 and the third edge 808, as it is drawn out and uncurled through the second side 62. Further, it is understood, that the curl spring 42 may contact only the fourth edge 810 as it is drawn out and uncurled through the second side 62. Further, it is understood, that the curl spring 42 may contact the same portions during recurling to assist in maintaining a location of the curl spring 42 within the housing 800. Maintaining the curl spring 42 within the housing 800 can assist in reducing its movement and therefore audible noise generation within the housing 800. Also, it resists or tends to prevent the curl spring 42 from at least partially extending or exiting from the housing 800 and, thereby, eliminating or reducing contact of the curl spring 42 with a wall of the jamb channel and reducing or eliminating audible noise caused by this contact.

Figure 15A:
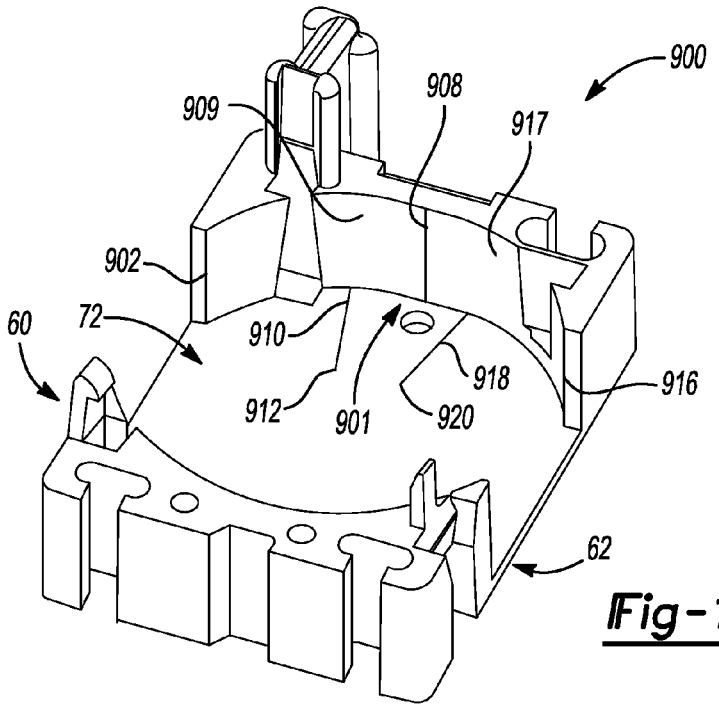
FIG. 15A is a perspective view of another carrier housing for use with a window balance assembly according to the principles of the present disclosure.
Figure 15B:
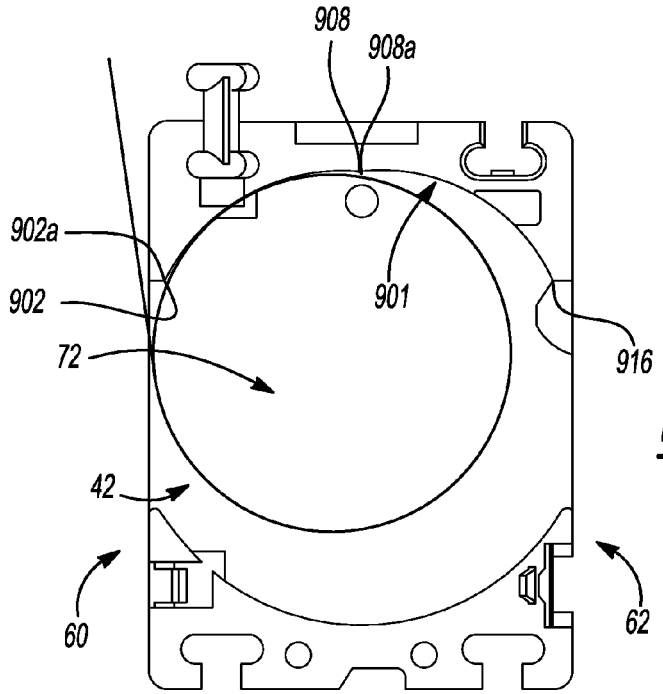
FIG. 15B is a plan view of the carrier of FIG. 15A.

Referring now to FIGS. 15A and 15B, a carrier housing portion 900 may include the cylindrical recess 72 that defines an arcuate housing region 901 while not including an integrated aperture for a receiver 50. The housing 900 may be substantially similar to housing 200 discussed above. The arcuate housing region 901 may be arranged as overlapping arcs of different radii. The arcuate housing region 901 may include a first end edge 902, a center peak 908, and a wall 909 therebetween. The first end edges 902 and the center 908 are arranged to be defined by a first radius 910 extending from a first center point 912. The arcuate housing region 901 may also include a second end edge 916 and a second wall 917 between the second end edge 916 and the center peak 908. The second wall 917 is defines by second radius 918 extending from a second center point 920.

Similar to the housing 200 illustrated in FIGS. 10A and 10B, the two center points 912 and 920 that include the respective radii 910 and 918, can define intersecting circles or arcs that form or define the retaining region center peak 908 of the arcuate housing region 901. Again, the arcuate housing region 901 can extend between the first and second sides 60, 62 of the housing 900 and define an entire surface area therebetween of the arcuate housing region 901. The first and second end edges 902 and 916 in combination with the center peak 908 can define less than the entire surface area for contact of the curl spring 42 when positioned within the housing 900.

According to various embodiments, the curl spring 42 can have a first contact location 902*a* at the first edge 902 either alone or in combination with a second contact location 908*a* at the center peak 908 as it is drawn out and uncurled from the first side 60. Similarly, the curl spring 42 can contact at least the second edge 916 either alone or in combination with the center peak 908 as it is drawn out of the second side 62 of the housing 900. Accordingly, as the curl spring 42 is manipulated and uncurled from within the housing 900, it can contact less than all of the surface area of the arcuate housing region 901. For example, the curl spring 42 may contact only the respective first or second edge 902 and 916 as the curl spring 42 is drawn out of the respective side 60, 62. Further, it is understood, that the curl spring 42 may contact the same portions during recurling to assist in maintaining a location of the curl spring 42 within the housing 900. Maintaining the curl spring 42 within the housing 900 can assist in reducing its movement and therefore audible noise generation within the housing 900. Also, it resists or tends to prevent the curl spring 42 from at least partially extending or exiting from the housing 900 and, thereby, eliminating or reducing contact of the curl spring 42 with a wall of the jamb channel and reducing or eliminating audible noise caused by this contact.

The various embodiments of reducing or minimizing contact of the curl spring 42 with respective portions of the arcuate housing regions of housings can lead to reduced audible noise and friction, as opposed to the curl spring 42 contacting the entire or majority of the surface area of the arcuate housing regions. For example, the curl spring 42 when contacting a majority of the retaining region may be contacting about 50% of the surface area, including about 40% to about 100% of the surface area of respective arcuate housing region. Without being bound by the theory, the large contact area and/or lack of a specific or limited contact region can lead to an audible or chatter level that has a measurable loud audible noise level. By minimizing or reducing contact, a measurable audible noise level having a decibel range that is significantly less, also referred to as a quiet audible noise level, may be achieved as compared to contacting a majority of the arcuate housing regions. Further to the theory, by providing the specific and controlled points of contact of the curl spring 42 with the arcuate housing portion the curl spring 42 may not resonate within the cylindrical recesses 72 of the housing to generate the loud audible noise level. Minimized or reduced contact can be contacting the curl spring 42 on a point or line of contact of the arcuate housing region, such as the one or selected number of the edges 406, 408, 410, or 412 of the housing 400 illustrated in FIGS. 11 and 12.

The edge contact can allow the curl spring to contact a substantially small portion of the arcuate housing region, such as less than 50%, including about 1-40% including about 5-20% of the arcuate housing region surface area. The quiet audible noise level as the curl spring 42 is uncurled from within the housing can be about 10% to about 80% of the loud audible noise level, including about 10% to about 25%, or more, of the loud decibel level. It is understood, according to the various embodiments, that the curl spring 42 can contact more than a single edge, such as making contact with a single edge in combination with a center point or one more edges defined a protuberance or depression within the arcuate housing region. Nevertheless, the total contact area of the curl spring 42 with the arcuate housing region can be about 2 to about 25% of the total surface area of the arcuate housing region to achieve a substantially reduced audible noise or the quiet audible noise level, as discussed above. It should be understood that the disclosed arcuate housing region is not limited to the housing construction and carrier of the window balance system specifically illustrated herein, but can be employed for use in the curl spring housings of a variety of window counterbalance systems, notwithstanding whether the housing is fixed (i.e., "fixed coil" systems) or moveable (i.e., "moving coil" systems) relative to the jambs 16.

Figure 16:
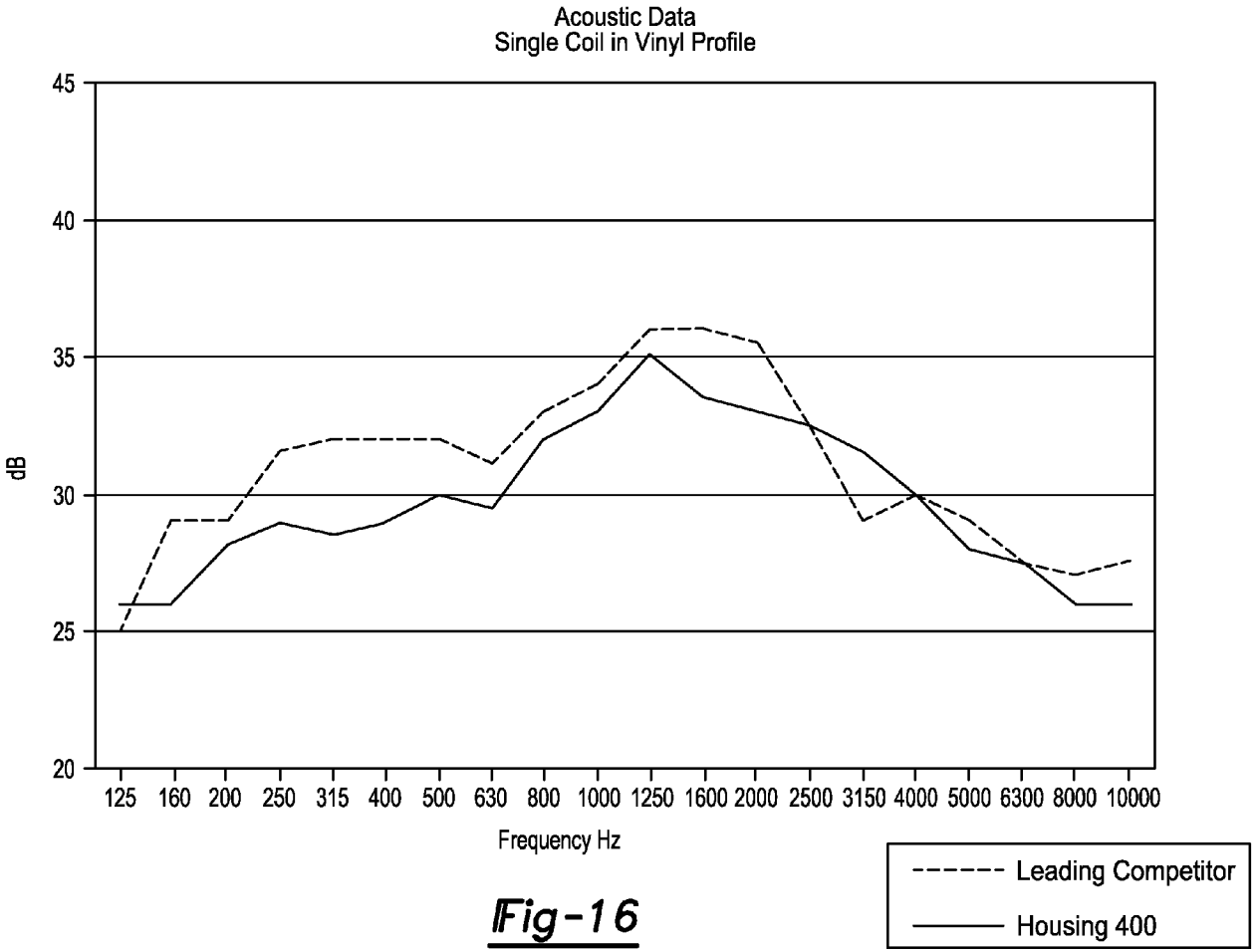
FIG. 16 is a graph of audible noise levels of various balance assemblies.

Further, as illustrated in FIG. 16, a reduced contact embodiment, such as the housing 400 having the curl spring 42 therein, illustrated in FIGS. 11A, 11B, and 12, can have a quiet audible noise level as illustrated by a solid line in FIG. 16. This sound level can be compared to a constant force balance housing having a fixed nest to contact the curl spring, as illustrated by the dashed line in FIG. 16. Accordingly, one skilled in the art will understand that providing the lower or smaller contact area, as disclosed herein, can provide a significantly lower quiet decibel level of audible noise when the curl spring 42 is drawn out and uncurled from the respective housings and/or re-curled into the housing. It is also understood, that the provided minimized contact portions forms portions that the curl spring 42 spins on as the curl spring is curled-out or re-curled on to minimize movement of the curl spring within the housing, according to various embodiments. Minimizing movement from side-to-side within the housing also minimizes audible noise. Further, as certain portions of the measured audible noise may be due to the curl spring 42 contacting a wall of the jamb channel in which the housing is moved, minimizing movement of the curl spring 42 within the housing may minimize or eliminate a chance of the curl spring 42 extending from or exiting the housing to contact the jamb channel.

The data illustrated in FIG. 16 was determined by measuring, in an anechoic chamber, a decibel level of sound over a frequency range of about 125 Hz to about 10,000 Hz by moving various balance housings in a test apparatus. The test apparatus included a test vinyl jamb channel track that is about four feet long into which a test balance assembly is placed. The curl spring is fixed near the top of the test vinyl jamb channel track. A human operator then moved the balance housing by engaging it with a tool. The balance housing is moved along the length of the track at a rate of about 1.5 seconds to cover the length of the test vinyl jamb channel track in one direction. The same operator moved both balance housings for which the graph in FIG. 16 illustrates data.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed:

1. A window balance system, comprising:

a housing member comprising a recess defining an arcuate housing region having a first end and a second end; and a curl spring configured to be positioned within the housing member and to contact at least a portion of the arcuate housing region;

wherein the arcuate housing region comprises a contact location intermediate the first end and the second end of the arcuate housing region and protruding into the recess;

wherein the contact location comprises a first non-rotatably fixed arcuate faced protuberance including a face and having a first edge and a second edge and a second non-rotatably fixed arcuate faced protuberance including a face and having a third edge and a fourth edge; and wherein the curl spring contacts the contact location as the curl spring is drawn out of the housing member.

2. The window balance system of claim 1 wherein the curl spring contacts one of the first and second edges of the first non-rotatably fixed arcuate faced protuberance when the curl spring is drawn out of the housing member on a first side of the housing member.

3. The window balance system of claim 2 wherein the curl spring contacts one or both of the third and fourth edges of the second non-rotatably fixed arcuate faced protuberance when the curl spring is drawn out of the housing member on a second side of the housing member.

4. The window balance system of claim 1, wherein the curl spring contacts less than 30% of a total surface area of the arcuate housing region and the housing member defines an aperture configured to engage a receiver, wherein the receiver is configured to engage a pivot bar.

5. The window balance system of claim 4, wherein a sound generated by the window balance system during drawing out of the curl spring from the housing member and retraction of the curl spring back into the housing member is less than about 35 dB over a frequency range of about 125 Hz to about 10,000 Hz.

6. The window balance system of claim 1 wherein the curl spring contacts the first and second edges when the curl spring is drawn out of the housing member.

7. The window balance system of claim 1 wherein the curl spring contacts the first edge when the curl spring is drawn out of the housing member.

8. The window balance system of claim 1 wherein the face of the first non-rotatably fixed arcuate faced protuberance and the face of the second non-rotatably fixed arcuate faced protuberance each have a surface area substantially less than a total surface area of the arcuate housing region.

9. The window balance system recited in claim 1 wherein when the curl spring is drawn out of the housing member, the curl spring contacts the contact location and generates a sound less than about 35 dB over a frequency range of about 125 Hz to about 10,000 Hz.

10. A window balance system, comprising:

a housing member comprising a recess defining an arcuate housing region having an arcuate surface;

a curl spring configured to be positioned within the housing member and to contact at least a portion of the arcuate housing region;

a first end edge of the arcuate housing region formed near an intersection of the arcuate surface and a side of the housing member; and a first non-rotatably fixed projection extending from the arcuate surface of the arcuate housing region into the recess to define a surface area less than a total surface area of the arcuate surface, the first projection comprising a face and having a first edge and a second edge;

wherein the curl spring is configured to contact one or both of the first end edge and the first projection as the curl spring is drawn out of the housing member, wherein the curl spring contacts both the first edge and the second edge when the curl spring is drawn out of the housing member.

11. The window balance system of claim 10 wherein the curl spring contacts the first end edge and both of the first edge and the second edge when the curl spring is drawn out of the housing member.

12. The window balance system of claim 10 wherein the first projection comprises an arcuate faced protuberance having the first edge and the second edge.

* * * * *